United States Patent [19]

Negishi et al.

[11] 4,059,950

[45] Nov. 29, 1977

[54] MULTIFILAMENT YARN HAVING NOVEL CONFIGURATION AND A METHOD FOR PRODUCING THE SAME

[75] Inventors: Takao Negishi; Kazuo Tomiita, both of Otsu, Japan

[73] Assignee: Toray Industries, Inc., Tokyo, Japan

[21] Appl. No.: 639,873

[22] Filed: Dec. 11, 1975

[51] Int. Cl.[2] ..... D02G 1/02; D02G 3/34

[52] U.S. Cl. ..... 57/140 J; 57/157 TS; 428/371; 428/399

[58] Field of Search ..... 57/157 R, 157 S, 157 TS, 57/140 R, 140 BY, 140 J; 428/369, 371, 399; 264/167, 168

[56] References Cited

U.S. PATENT DOCUMENTS

| | | | |
|---|---|---|---|
| 3,425,206 | 2/1969 | Holton | 57/140 J |
| 3,587,221 | 6/1971 | Buzano | 57/140 J |
| 3,683,610 | 8/1972 | Buzano | 57/140 J |
| 3,691,748 | 9/1972 | Buzano | 57/140 J |
| 3,698,177 | 10/1972 | Nyfeler | 57/140 J |
| 3,772,747 | 11/1973 | Buzano | 57/140 J X |

*Primary Examiner*—John Petrakes
*Attorney, Agent, or Firm*—Armstrong, Nikaido & Marmelstein

[57] ABSTRACT

A polyester yarn composed of a plurality of individual fibrous materials such as endless filaments or fibers. Each of these fibrous material is provided with cross-sectional thicker portions, thinner cross sectional portions and intermediate thickness-size portions randomly distributed along the axial direction thereof in a particular condition of distribution of cross-sections of these fibrous material. The above-mentioned polyester yarn involved a textured yarn applied to a drawn polyester multifilament yarn having the above-mentioned basic condition. To produce the polyester yarn according to the present invention, it is the basic condition that the undrawn polyester multifilament yarn should be drawn under a condition of a drawing ratio below a natural draw ratio of undrawn filaments of said undrawn multifilament yarn and a drawing temperature over a crystallizing initiating temperature of said undrawn filaments.

9 Claims, 14 Drawing Figures

MULTIFILAMENT YARN HAVING NOVEL CONFIGURATION AND A METHOD FOR PRODUCING THE SAME

SUMMARY OF THE INVENTION

The present invention relates to a polyester yarn consisting of a plurality of fibrous materials such as filaments or fibers, wherein each individual fibrous material is provided with thicker portions, thinner portions and intermediate size portions distributed irregularly in the direction of the axis thereof and among individual fibrous materials, and a modification of the above-mentioned multifilament yarn, and methods for producing the same.

It is well known that the thickness of any natural fiber varys irregularly in the direction of the fiber axis but, in general, the sectional area changes only gradually in the fiber axis direction.

Man-made fibers are generally produced by spinning and drawing, and they are substantially uniform in thickness. It is known, however, that irregularlity or unevenness in the fiber thickness of individual filaments can be formed by changing the extrusion amount, the take-up speed, the spun length or the spinning atmosphere in the spinning step, or by changing the draw ratio, the drawing zone length or the drawing atmosphere in the drawing step. The thickness variation formed by the above method is distributed regularly with respect to the direction of the filament axis. From the point of view of the principle of formation of this thickness variation, it may be considered possible to distribute such unevenness irregularly with respect to the direction of the filament axis by performing the above change in an irregular manner; however, from the practical standpoint, it is very difficult to perform such operation on an industrial scale. In fact, no attempt has been made to do so. It is even more difficult to bring about different phases of the thickness variation among respective individual filaments and, in many cases, the phases of the thickness variation are substantially identical among respective individual filaments.

It is also known that when undrawn filaments having a constant stress elongation region, as the tensile strength-elongation characteristic, are drawn at a draw ratio lower than the natural draw ratio of said filaments, unstretched portions are irregularly left on the drawn filaments with respect to the direction of the filament axis. However, in these filaments formed by performing the drawing at a draw ratio lower than the natural draw ratio, portions having a fixed smaller thickness and portions having a fixed larger thickness are formed alternately. Further, in most of multifilament yarns formed by using this known method, the phases of the thickness variation are substantially identical among respective individual filaments.

It is a primary object of the present invention to provide a multifilament yarn comprising filaments or fibers, each having a large unevenness in the thickness and including thicker portions, thinner portions and intermediate size portions distributed irregularly in the direction of the filament axis, and in which the thickness unevenness phases are different and irregular among respective fibers or filaments.

Another object of the present invention is to provide a method for preparing multifilament yarns having the above-mentioned peculiar configuration.

By the term "multifilament yarn" used in the instant specification and claims is meant a multifilament yarn comprising a plurality of individual filaments or modification of said multifilament yarn. A common structural characteristic of the multifilament yarns of the present invention is as follows.

The multifilament yarn of the present invention comprises a plurality of individual filaments or fibers, or a combination of filaments and fibers, each having thicker portions, thinner portions and intermediate size portions distributed irregularly in the direction of the filament or fiber axis. The sectional area distribution of the multifilament yarn-constituting filaments (or fibers) is deviated to the thinner side and the degree of variability of the sectional area in the filaments or fibers is within a range of from 7 to 30%. When the sectional area distribution is divided into a plurality classes from the average value toward the thicker side by widths corresponding to ½ of the standard deviation, the probability of distribution in one divided class is less than three times the probability of distribution in the divided class adjacent to said one divided class on the thinner side. Still further, the standard deviation of the average sectional area of individual filaments (fibers) in the section of the multifilament yarn is smaller than the quotient of the standard deviation of the sectional areas of the filaments (or fibers) by the one-fourth power of the average number of the filaments (or fibers) constituting the sectional area of the multifilament yarn.

As a result of our research on methods for preparing multifilament yarns having the above structural characteristic, it has been found indispensable to draw polyester multifilament yarn under the specific drawing conditions described hereinafter. Further, in order to obtain the above multifilament yarn, it has been found preferable to apply a texturing processing such as a false twisting treatment, a frictional false twisting treatment or an interlacing treatment using a jet of fluid upon the multifilament yarn after the above-mentioned drawing treatment; or, to apply the conventional draft cut operation to the multifilament yarn after the above-mentioned drawing treatment so as to produce a spun yarn.

The so prepared yarns have peculiar hand-feel and bulkiness which varies according to the processing conditions; and, when they are formed into woven fabrics or knitted articles, products having excellent hand-feel and bulkiness can be obtained.

DETAILED DESCRIPTION OF THE PREFERRED EMBODIMENTS

The basic configuration of the multifilament yarn of the present invention will now be described.

Figure 1:
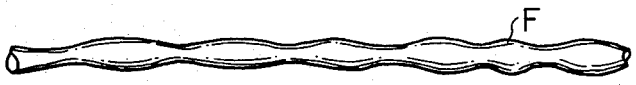
FIG. 1 is a schematic elevational view of individual filaments extracted from a multifilament yarn according to the present invention.

FIG. 1 is a view illustrating the variation of the thickness, in the direction of the filament axis, in an optional one filament of the multifilament yarn of the present invention composed of a plurality of individual filaments. As is seen from FIG. 1, the multifilament yarn of the present invention comprises a plurality of filaments (or fibers) F, each having thicker portions, thinner portions and intermediate size portions distributed irregularly with respect to the direction of the filament axis. In connection with the variation of the sectional areas of the filaments (or fibers), the multifilament yarn of the present invention satisfies the four requirements mentioned below.

Figure 2:
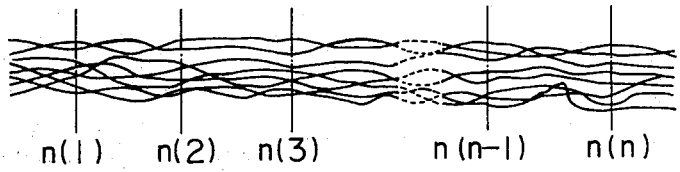
FIG. 2 is a schematic elevational view of an interlaced multifilament yarn according to the present invention.

As shown in FIG. 2, in the multifilament yarn Y composed of individual filaments, the number of filaments constituting the section of the multifilament yarn at $n$ positions equidistantly spaced or randomly chosen are represented by $n(1), n(2), n(3), \ldots, n(n-1)$ and $n(n)$, respectively. Table 1 shows that, in the $n$th section of the multifilament yarn, the sectional areas of $n(i)$ pieces of the individual filaments are represented by $S(i,1)$, $S(i,2)$, $S(i,3), \ldots, S(i,n(i)-1)$ and $S(i,n(i))$, respectively. The average sectional area $S(i)$ of individual filaments in an optional section of the multifilament yarn is represented as:

$$S(i) = \sum_{j=1}^{n(i)} \frac{S(i,j)}{n(i)} \quad (1)$$

Table 1

| Position of Section of a Multifilament Yarn | 1 | 2 | ..... i | ..... m |
|---|---|---|---|---|
| Number of Filaments Constituting Section of Multifilament Yarn | n(1) | n(2) | ..... n(i) | ..... n(m) |
| Sectional Areas of Individual Filaments | S(1,2)<br>S(1,2)<br>S(1,3)<br>.<br>.<br>.<br>S(1,n(1)) | S(2,1)<br>S(2,2)<br>S(2,3)<br>.<br>.<br>.<br>S(2,n(2) | ..... S(i,1)<br>..... S(i,2)<br>..... S(i,3)<br>.<br>.<br>.<br>..... S(i,n(i)) | ..... S(m,1)<br>..... S(m,2)<br>..... S(m,3)<br>.<br>.<br>.<br>..... S(m,n(m)) |
| Average Filament-sectional Area in an Optional Section of the Multifilament Yarn | S(1) | S(2) | ..... S(i) | ..... S(m)) |

FIRST REQUIREMENT

Distribution of the sectional area of the optional axial position of individual filaments (or fibers) should deviate to the thinner side. More specifically, the particular relation must be satisfied that the central value of the above-mentioned distribution of N filaments should be smaller than the average value S of the sectional area of the optional axial position of individual filaments (or fibers), wherein $$N = \sum_{i=1}^{m} n(i) \quad (2)$$

wherein $$\bar{S} = \sum_{i=1}^{m} \frac{[n(i)\,S(i)]}{N} \quad (3)$$

Note: when N is an even number, the central value is an average value of the sectional area of the (N/2)th filament counted from the largest sectional area among sectional areas of N filaments and the sectional area of the (N/2)th filament counted from the smallest sectional area, and; when N is an odd number, the central value is an average value of the sectional area of the [(N+1)/2]th filament counted from the largest sectional area among sectional areas of N filaments and the sectional area of the [(N+1)/2]th filament counted from the smallest sectional area and the average value S of the sectional areas of N filaments.

This requirement means that a larger number of thinner portions and a smaller number of thicker portions are present in the randomly mingled state in the multifilament yarn. If the above requirement is not satisfied, namely if a smaller number of thinner portions and a larger number of thicker portions are present in the mingled state in the multifilament yarn, the intended denier-mixing effect of the present invention cannot be attained and the characteristics of the thicker portions are mainly manifested.

SECOND REQUIREMENT

The degree of variability, i.e., the coefficient of variation, of the sectional area of the filaments should be between 7% and 30%. Namely, when the standard deviation V is represented as:

$$V^2 = \sum_{i=1}^{m} \sum_{j=1}^{n(i)} \frac{[S - S(i,j)]^2}{N} \quad (4)$$

the degree of variability, V/S, where S is the mean value of the sectional areas, should be:

$$0.07 < V/S < 0.30 \quad (5)$$

When the degree of variability is lower than 7%, the intended effect due to the thickness or denier variation is insufficient. When the degree of variability is higher than 30%, the thicker portions are not well harmonized with the entire assembly. A preferred degree of variability, V/S, is between 10% and 20%.

THIRD REQUIREMENT

Figure 3:
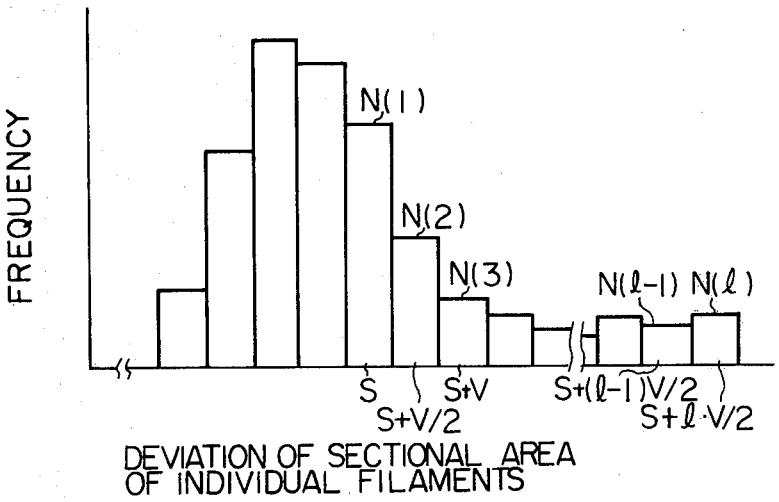
FIG. 3 is a distribution diagram indicating a relation between the probability of distribution and classes of cross-sectional area of individual filaments (or fibers), forming the multifilament yarn according to the present invention.

FIG. 3 shows the relation between frequency (ordinate) and sectional areas of individual filaments at their optional axial positions (abscissa). The abscissa is divided by a value of half of the standard deviation V, and the sample number is N. As shown in FIG. 3, the frequency of the sectional areas included in any classes from the average value S toward the thicker side are N(1), N(2), N(3), . . . N($l-1$) and N($l$), respectively, and the frequency of sectional areas included in class N($l+1$) and higher classes is zero. In short, in the frequency distribution shown in FIG. 3, the following relation should be established.

$$N(i+1)/N(i) < 3 (i=1,2,3, \ldots l) \quad (6)$$

This requirement indicates that intermediate thickness portions are present in the multifilament yarn. Better results are obtained when the following relation is established.

$$N(i+j)/N(i) < 3 (i=1,2,3, \ldots l) \quad (7)$$

$$(j=1,2,3, \ldots l)$$

If no intermediate thickness portions are present in the multifilament yarns, the thicker portions show undesired effects as foreign matter and the intended denier mixing effect cannot be attained.

FOURTH REQUIREMENT

When the standard deviation W of the average sectional area of the filaments in the section at the optional positions of the multifilament yarn is expressed as:

$$W^2 = \sum_{i=1}^{m} \frac{n(i)\,[S - S(i)]^2}{N} \quad (8)$$

and when the average number $n$ of the filaments constituting the section of the multifilament yarn is expressed as:

$$n = N/m \quad (9)$$

the following condition should be satisfied.

$$w < V/(n^{\frac{1}{2}}) \quad (10)$$

Figure 4:
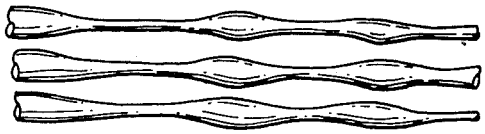
FIG. 4 is a schematic elevational view of a part of the multifilament yarn which is an undesirable condition from the point of view of the present invention.
Figure 5:
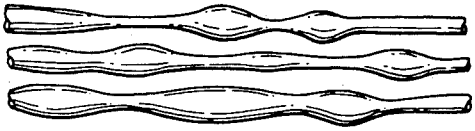
FIG. 5 is a schematic elevational view of a part of the multifilament yarn which is a desirable condition from the point of view of the present invention.

In order to simplify this problem, a multifilament yarn having the relation:

$$n = n(i) \; (i=1,2,3, \ldots ,m) \quad (a)$$

will now be discussed. The degree of variability of the average sectional area of the filaments in the sections at the optional positions of the multifilament yarn, i.e., W/S, is expressed as:

$$W/S = V/S \quad (b)$$

if the thickness unevenness phases are completely identical among respective filaments as shown in FIG. 4. However, if the thickness unevenness phases are completely irregular among respective filaments, W/S is expressed as:

$$W/S = (V/\sqrt{n})/S \quad (c)$$

The actual degree of variability, $W/S$, is intermediate between the equations ($b$) and ($c$). If the actual degree $K$ of irregularity of the thickness unevenness phases of respective filaments constituting the multifilament yarn is expressed as:

$$K = \frac{\log\left(\frac{V}{S}\right) - \log\left(\frac{W}{S}\right)}{\log\left(\frac{V}{S}\right) - \log\left[\frac{\left(\frac{V}{\sqrt{n}}\right)}{S}\right]} \quad (d)$$

the multifilament yarn of the present invention satisfies the following condition.

$$K > 0.5 \quad (e)$$

The equation (10) can be derived from the equations ($d$) and ($e$).

As is seen from the foregoing illustration, the multifilament yarn having the above basic configuration comprises a plurality of filaments (or fibers), each having thicker portions, thinner portions and intermediate size portions distributed randomly in the direction of the filament axis. If this multifilament yarn satisfies the first requirement and the other requrements represented by the above equations (5), (6) and (10) with respect to the distribution of sectional areas of the filaments, the thicker portions, thinner portions and intermediate size portions of the filaments are appropriately mixed and dispersed and various excellent effects can be attained.

That is, first of all, a high denier-mixing effect can be attained. Ordinary denier-mix multifilament yarn is formed by a bundle of filaments having different thickness, and such yarn is defective in that mixing of the filaments with respect to the sectional direction of the resulting bundle is insufficient. In contrast, in a filament bundle having a configuration of the multifilament yarn specified in the present invention, denier-mixing is good with respect to the sectional direction of the bundle.

Ordinary different denier-mix spun yarn is formed by fibers having different thickness. In these yarns, however, various undesired phenomena are caused because the spinning characteristics, especially the behaviors of the fibers on drafting, are different among the fibers owing to the difference in their thickness. Spun yarn which is a modification of the multifilament yarn specified in the present invention, can be obtained without causing such undesired phenomena.

Secondly, when the axial variation of thickness of filaments (or fibers) results in a difference in tensile strength or elongation, if in the tow spinning process a tow having a similar configuration to the multifilament yarn specified in the present invention is utilized, a bundle of fibers having excellent uniformity of thickness and a random dispersion of fiber ends can be obtained by very simple steps. If the so prepared bundle of fibers is spun, a spun yarn having a particular hand-feel can be obtained as mentioned in Experiment 2 described hereinafter. Further, if the so prepared bundle of fibers are subjected to an interlacing treatment using a fluid jet, individual filaments are often cut at their weak points, namely at points of larger sectional areas, and since individual filaments are interlaced with one another, there can be obtained products resembling spun yarns composed of staple fibers. Furthermore, if the above multifilament yarn is subjected to a false twisting treatment, frictional treatment or other texturing treatment, in addition to the quality characteristic of such processing the above-mentioned effects of the thickness variation in the direction of the filament axis are clearly manifested.

Still further, when differences of various properties such as dyeability, thermal shrinkability and melting point are brought about by the thickness variation in individual filaments, in the multifilament yarn of the present invention there can be attained much better mixing and dispersing effects than those attainable in products formed by mix weaving of different yarns or blending fibers differing in the foregoing properties.

In order to determine whether or not a multifilament yarn has the structure and configuration specified in the present invention, it is necessary to test whether or not the foregoing requirements are satisfied with respect to a large number ($m$ is at least 30, preferably at least 50) of the sections of the multifilament yarn and a large number (N is at least 500, preferably at least 1000) of sections of individual filaments. It is preferred that the space between two adjacent sections of the multifilament yarn to be checked be relatively long. For example, this space should be at least several centimeters, and a space of 1 meter is preferable. The number $n(i)$ of the filaments constituting the section of the multifilament yarn may be an actually measured value in the optional section of the multifilament yarn. Filament sectional areas $S(i,k)$ and $S(j,k)$ in the tow sections of the multifilament yarn need not be the same.

As a result of our experiments it has been found that multifilament yarns of the present invention can easily be prepared when polyester synthetic filaments are used as raw materials. Accordingly, the process for the preparation of multifilament yarns of the present invention will now be described in detail with reference to Experiments using polyester undrawn synthetic multifilament yarn as raw materials.

Polyethylene terephthalate was melt spun and taken up at a rate of 2500 m/min to obtain a multifilament yarn of 300 denier × 48 filaments. While this yarn was being drawn at a drawing speed of 150 m/min and drafting percentage (draw ratio/natural draw ratio) of 83% in a drawing zone having a length of 60 cm, it was placed in contact with a hot plate having a radius of curvature of 3 m and a length of 30 cm and maintained at 130° C along its central portion of a length of 15 cm. The so drawn multifilament yarn was found to satisfy the requirements of the present invention. Filaments in thicker portions had better dyeability than filaments in thinner portions, and the former had higher thermal shrinkability and higher elongation. Even when this multifilament yarn was subjected to a customary false twisting treatment, it still satisfied the requirements of the present invention. When the false twisting treatment was carried out at a false twist number of 2400 per meter and a temperature of 220° C, in the false twisted yarn, filaments in thicker portions had better dyeability than filaments in thinner portions. When the false twisting treatment was carried out at a false twist number of 1700 per meter and a temperature of 230° C, filaments in thicker portions were much more brittle than filaments in thinner portions. When this false-twisted multifilament yarn was subjected to an interlacing treatment using fluid, a great number of fluffs were formed. If the false twisting was carried out at a false twist number of 1900 per meter and a temperature of 240° C, filaments in the thicker portions were fusion-bonded.

Each of the multifilament yarns prepared in the same manner as described above, except that the spinning speed was changed to an ordinary spinning speed of 1000 m/min or an experimentally accelerated speed of 3800 m/min or at the drawing speed the curvature radius of the heat plate was changed to 200 mm or the heat plate temperature was changed to 100° C, or that the drafting percentage was changed to 100%, was found to fail to satisfy the requirements of the multifilament yarn of the present invention.

From the foregoing experiment results, it is impossible to derive definite conditions or principles for obtaining the multifilament yarn of the present invention. However, it has been found that when filaments free of even a slight sprout of crystallization before drawing are drawn at a high temperature (higher than the crystallization initiating temperature), flow drafting is caused to occur and the filaments are uniformly drafted even if the drafting percentage is lower than 100%. Further, even if the friction resistance by the contact with the heat plate is high and the stretching tension increases with the temperature increase in filaments, they are uniformly drafted. When crystallization has already occurred in filaments before stretching, for example, in the case of filaments spun at 1000 m/min, even if they are heat-treated at 140° C and stretched at a high temperature, intermediate size portions are not substantially formed. Similarly, even if such filaments are stretched at a high temperature without performing the above pre-heating, intermediate size portions are not substantially formed. In each case, the resulting multifilament yarn fails to meet the requirements of the multifilament yarn of the present invention.

As is apparent from the foregoing illustration, the drawing conditions are critical for obtaining the multifilament yarn of the present invention. As is seen from Examples presented hereinafter, as a result of repeated experimental tests, it has been found that in order to obtain multifilament yarn having the peculiar structure and configuration specified in the present invention, it is indispensable to stretch polyester undrawn multifilaments at a draw ratio lower than the natural draw ratio and at a temperature higher than the crystallization temperature.

As mentioned above, the operational condition of the drawing process is one of the very important factors in producing the multifilament yarn according to the present invention. To find the preferable condition to drawn the undrawn multifilament yarn, several experimental tests were carried out as hereinafter disclosed.

EXPERIMENT 1

Figure 6:
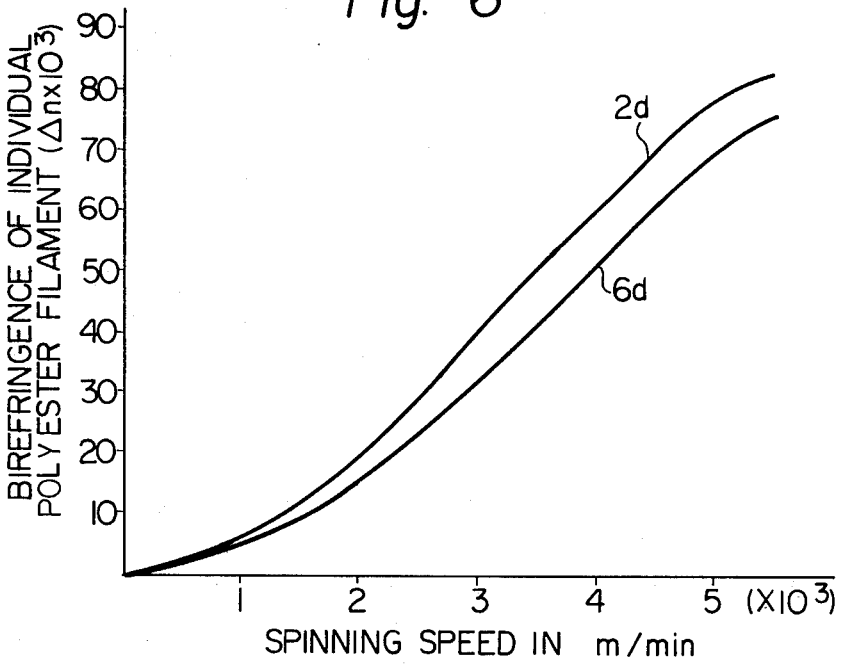
FIG. 6 is a diagram indicating a relation between birefringence of individual polyester filaments of an extruded multifilament yarn and the spinning speed of the extruded multifilament yarn produced in experimental research according to the present invention.
Figure 7:
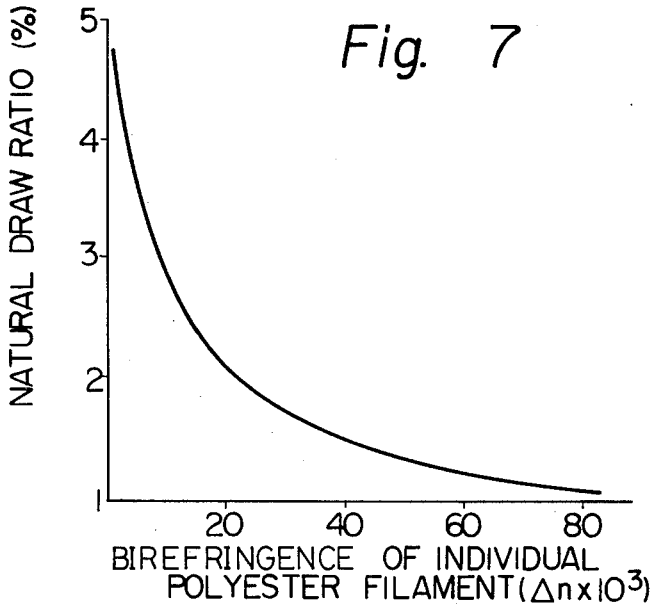
FIG. 7 is a diagram indicating a relation between birefringence of individual polyester filaments of the extruded multifilament yarn shown in FIG. 6 and natural draw ratio (%) of said individual filaments.
Figure 8:
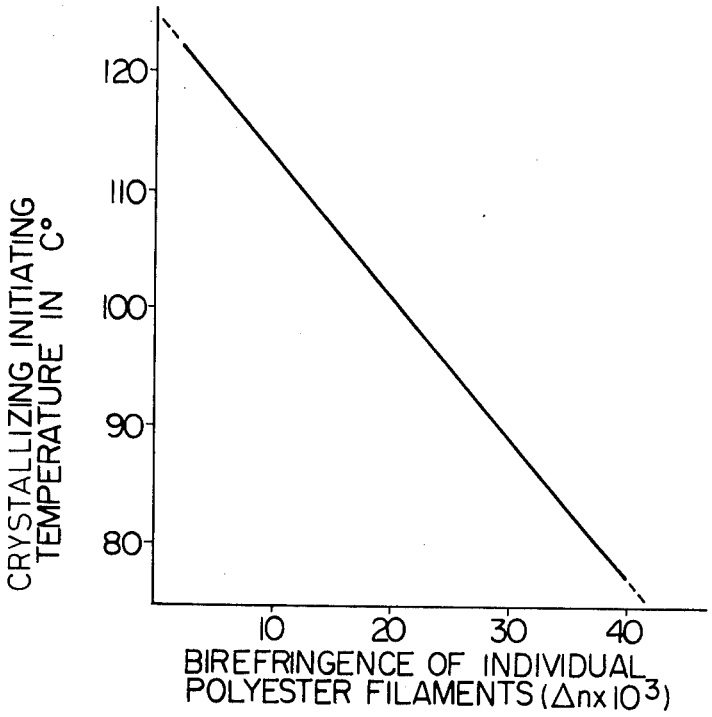
FIG. 8 is a diagram indicating a relation between birefringence of individual polyester filaments of the extruded multifilament yarn shown in FIG. 6 and the crystalizing initiating temperature of said individual filaments.

Several undrawn polyethylene telephthalate multifilament yarns were produced under such conditions that 19 different spinning speeds, 1000, 1250, 1500, 1750, 2000, 2250, 2500, 2750, 3000, 3250, 3500, 3750, 4000, 4250, 4500, 4750, 5000, 5250 and 5500 m/min, were applied, respectively. The thusly produced multifilament yarns were composed of 48 individual filaments, and the expected thickness of the individual filaments of these several different multifilament yarns were 2*d*, 3*d*, 4*d*, 5*d* and 6*d*. The term expected thickness means (the thickness of undrawn individual filament)/(natural draw ratio of the undrawn individual filament). The above-mentioned thickness of individual filaments corresponds to (thickness of undrawn individual filament)/(natural draw ratio). After the yarns were produced, the birefringence ($\Delta n$) of the polyester individual filaments were measured. The relation between the spinning speed (*m*/min) and the birefringence ($\Delta n$) of these individual filaments is shown in FIG. 6. To simplify the representation of the above-mentioned relation, only the data concerning the individual filaments with a thickness of 2*d* and 6*d* are shown in FIG. 6. However, it may be understood that the data concerning the individual filaments with a thickness of 3*d*, 4*d* and 5*d* fall between the two characteristic curves in FIG. 6. The relation between the birefringence ($\Delta n$) of the individual undrawn filament and the natural draw ratio (%), and the relation between the birefringence ($\Delta n$) of the individual undrawn filament and the crystalizing initiating temperature thereof were confirmed to be as shown in FIGS. 7 and 8. The above-mentioned undrawn multifilament yarns were drawn under predetermined provisional conditions. The effect of several different drawing ratios, processing temperatures, constant angles ($\theta$) of the yarn with a curved heater surface and heating times ($t$), particularly with regard to the effect of the application of such drawing ratios near the natural draw ratio and such drawing temperature near the crystallizing initiating temperature, were examined.

Plain knit fabrics of 24 gauge were produced by utilizing each of the above-mentioned drawn multifilament yarns. A dye liquid was then prepared based on: Amacron Blue RLS 1.3% owf (object weight fraction), carrier, Polyescor BD 10% owf, and; dispersion agent, USN Salt No. 1200 1%. After that the following dying test was carried out. The knit fabrics were immersed into the dye liquid in a liquid ratio 1:50, and the dying operation was started from 40° C. After 30 minutes of elevation of the temperature of the dye liquid, the began to boil and, then, the dying operation was further continued for 60 minutes. After the above-mentioned dying, the thicker portions of the individual filaments were dyed a deep color, while the thinner portions of the individual filaments were dyed a paler color and, consequently, the knit fabrics of the above-mentioned tests were dyed a salt and pepper blue. Therefore, the distribution condition of the thicker, thinner and intermediate size portions of the individual filaments, in other words, the configuration of the drawn multifilament yarn according to the present invention, could be easily examined.

From the above-mentioned experimental test, it was confirmed that, if the draw ratio is below the natural draw ratio of the undrawn filament, and the drawing operation is carried out at a temperature above the crystallizing initiating temperature, the preferable configuration of the multifilament yarn according to the present invention can be produced. The above-mentioned conditions are the basic conditions for producing the polyester multifilament yarn according to the present invention. In the above-mentioned experimental tests, it was further confirmed that, the preferable uniform distribution of deep and pale blue colors in the dyed knit fabric could be attained if the natural draw ratio of the undrawn polyester filament was in a range between 1.2 and 2.5%.

Figure 9:
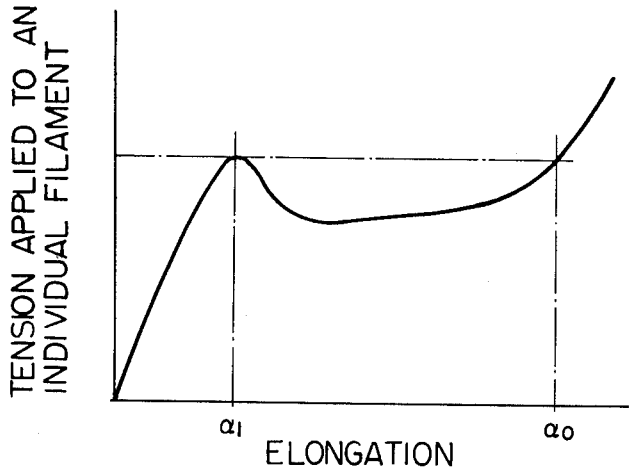
FIG. 9 is a diagram indicating a relation between a tension applied to an individual filament and an elongation of said filament.

Note: The natural draw ratio (%) of the undrawn individual filament is measured by the following tensil test. Generally, the relation between yarn tension and a draw ratio (length of a test piece of individual filament under load)/(original length of the test piece) is represented as shown in FIG. 9. The elongation ($\alpha 0$) under a yarn tension (load), which is identical to the yarn tension corresponding to the elongation ($\alpha 1$) which is a first yield point, is called "the natural draw ratio". Consequently, the natural draw ratio of the undrawn individual filament can be easily measured by utilizing the conventional Instron tester.

EXPERIMENT 2

Figure 10:
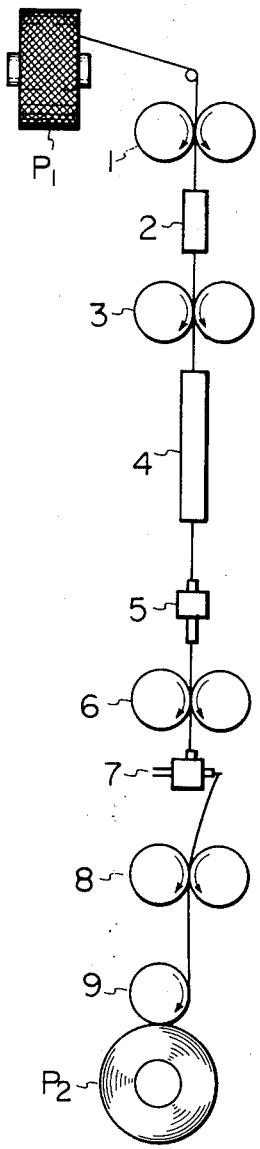
FIG. 10 is a schematic side view of an apparatus for producing an interlaced multifilament yarn according to the present invention.

A polyethylene-telephthalate resin was melt spun and taken-up at a takeup speed of 2500 m/min, and a yarn package P of an undrawn multifilament yarn of 120*d*/36*f* was produced. This yarn package was utilized for producing an interlaced textured multifilament yarn according to the present invention by means of a one process equipment comprising a drawing mechanism, a false twisting apparatus, an interlacing apparatus and a takeup device as illustrated in FIG. 10. The operational conditions of the machine elements of the above-mentioned one process equipment are as follows.

Figure 11:
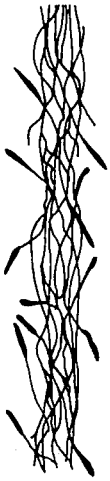
FIG. 11 is a schematic elevational view of the interlaced multifilament yarn produced by the apparatus shown in FIG. 10.

A first yarn feed device 1: yarn feed speed 200 m/min
A first heater 2: heating temperature 150° C
A second yarn feed device 3: yarn feed speed 300 m/min
A second heater 4: heating temperatur 210° C
A false twisting device 5: number of false twists 1500 t/m
A third yarn feed device 6: yarn feed speed 310 m/min
Interlacing treating device 7: air pressure 5.5 kg/cm$^3$
A fourth yarn feed device 8: yarn feed speed 300 m/min In the drawing of FIG. 10, the yarn package $P_2$ of the textured yarn is formed by the action of a friction roller 9. In the above-mentioned experiment, the natural draw ratio of the undrawn multifilament yarn was 1.68, and the crystallizing initiating temperature was 110° C. The thus produced interlaced textured yarn was provided with numerous short fuzzy fibers as shown in FIG. 11, and it was observed that the free end portions of these fuzzy fibers was provided with thicker thickness in comparison with other portions. The above-mentioned yarn had a very uniform thickness along the yarn axis and the *u*% thereof was 1.4%; which *u*% is smaller than $80\sqrt{n}$, where n represents the average number of fibers (filaments) counted in a cross section at an optional axial position thereof. The average thickness of individual filaments (or fibers) was 2.1 denier, while the average thickness of the free end portion (10 mm) of the fuzzy fibers was 2.8 denier. A plain knitted fabric of 24 gauge was produced by the above-mentioned interlaced textured yarn, and it was confirmed that this knitted fabric had a wool-like hand-feel and excellent resistance against the creation of pilling.

EXPERIMENT 3

The multifilament yarns (*3d, 4d*) produced in the experiment 1 were false twisted by means of a conventional false twisting apparatus. In this experiment 3, the effect due to the number of false twists was examined. In the false twisting zone, the material yarns were heat treated under a temperature higher than the temperature applied in the drawing process and for a longer time than the heat applying time in the drawing process.

The thus produced false twisted yarns were tested by a knitting and dying test, which was similar to the above-mentioned experiment 1, and the following result was obtained. That is, if the number of false twists was less than $3000/\sqrt{D}$, where D represents the total denier of the multifilament yarn, the knitted fabric was dyed in deep shade color of pepper and salt blue; while if the number of false twists exceeded $15000/\sqrt{D}$, the knitted fabric was dyed in pale blue. When the number of false twists exceeded $27000/\sqrt{D}$, the variation of the tensile strength and elongation of the individual filaments of the false twisted multifilament yarn became very small. The above-mentioned knitted fabrics has a preferable harshness and bulkiness.

EXPERIMENT 4

Figure 12:
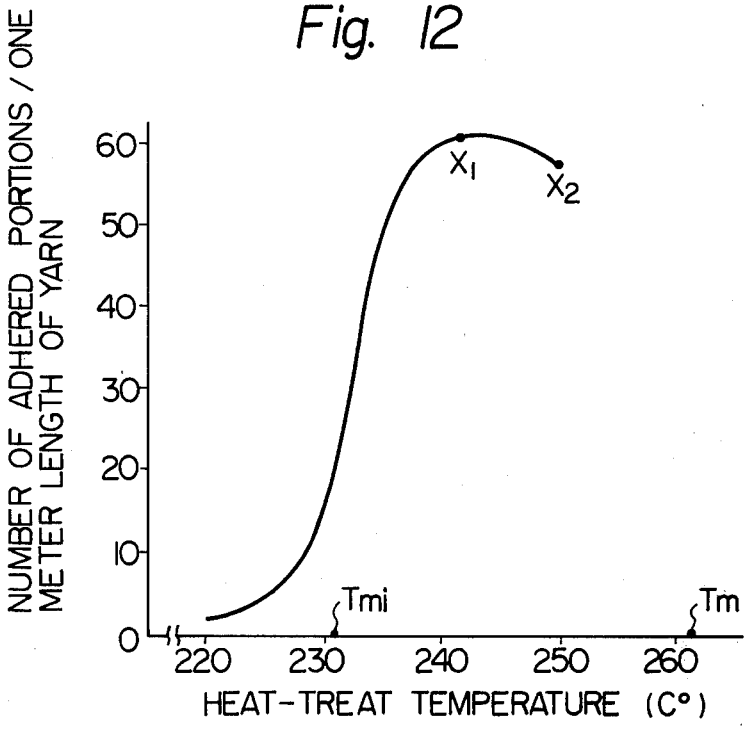
FIG. 12 is a diagram indicating the relation between the heat-treat temperature and number of adhered portions per one meter length of multifilament yarn according to the present invention.

In experiment 3, the effect of the temperature applied to the material multifilament yarns was examined. In experiment 5, the above-mentioned applied temperature was changed to between 220° – 253° C. It was observed that, the number of untwisted portions, resulting from the individual filament being only partly melted and adhered each other, was remarkably increased if the heating temperature exceeded the melting initiation temperature (Tmi), and; further that, if the heating temperature exceeded a temperature Tmi + 10° C, which is represented by a point $X_1$ in FIG. 12, the number of untwisted portions tended to decrease. In the above-mentioned region of the heating temperature between Tmi and $X_1$, the above-mentioned partly adhered portions could be separated into individual filaments. It was also observed that, if the heating temperature was increased above the condition represented by point $X_1$ to a temperature $X_2$ near the melting point, the length of the portions, which could not be separated into the individual filaments became longer and the number of the melt adhered portions increased. If, the heating temperature exceeded the condition represented by the point $X_2$ almost the entire portion of the multifilament yarn was melt-adhered, and the false twisting operation could not be carried out if the heating temperature reached the melting point (Tm).

According to this experiment, it was confirmed that the most preferable condition of the heating temperature is a temperature which is a little higher than the melting initiation temperature (Tmi) of the material yarn, because with such a heating temperature individual filaments are adhered to thicker portions of the filaments in the melt-adhered portions of the yarn. Such melt-adhered portions are distributed randomly along the lengthwise direction of the false twisted yarn. This textured yarn has good harshness and softness.

EXPERIMENT 5

Two undrawn multifillament yarns, produced as in Experiment 1, one composed of 48 individual filaments, each having a thickness of 2 denier, and the other composed of 48 filaments, each having a thickness of 6 denier, were twisted respectively. Then these twisted multifilament yarns were drawn under the same drawing conditions as in Experiment 1. In the above-mentioned experiments, the number of twists imparted to these yarns were changed so as to obtain several twisted and drawn samples. Observation of the yarn samples so prepared revealed that, as the number of twists increases, the standard deviation (W) of the average sectional area of individual filaments in optional sections of the yarn increases, and; that if a number of twist exceeding $250/\sqrt{\text{denier}}$ of the yarn (in turns per meter) the above-mentioned standard deviation (W) becomes larger than the one-fourth power of the quotient of the standard deviation of the sectional areas of the filaments by the average number of the filaments constituting the sectional area of the multifilament yarn. Consequently, in such condition, the multifilament yarn thus produced has a configuration different from the multifilament yarn according to the present invention.

EXPERIMENT 6

Polyethylene terephthalate was melt-spun through a single spinneret at a spinning speed (take-up speed) of 3,5000 m/min to concurrently form a combination of 30 filaments each having an expected thickness of 3 denier and 18 filaments each having an expected thickness of 6 denier. It is well known that the thinner filaments has a natural draw ratio lower than that of the thicker ones. The multifilament yarn so produced was then drawn at a temperature, higher than the crystalization temperature of polyethylene terephthalate with a draw ratio which was higher than the natural draw ratio of the thinner filaments, but lower than the natural draw ratio of the thicker filaments. While the thinner filaments could be uniformly drawn, uneven drawing was imparted to the thicker filaments and brittle portions were produced in the individual filaments having a thicker thickness. The drawn yarn was then subjected to the action of an interlacing air jet, under the conditions as herein before described with reference to FIG. 10, whereupon some thicker filaments broke at the brittle portions and the interlaced product as shown in FIG. 11 was obtained. Since the thus produced yarn was provided with thin continuous filaments, the yarn had an adequate tenacity, revealling the fact that a high degree of interlacement was unnecessary for the practical strength of the yarn. The yarn was provided with thinner continuous filaments at its center and the broken thicker fibers on its outer surface. The yarn was fairly flexible, although the touch was slightly coarse.

EXPERIMENT 7

At each of 19 different spinning speeds, separated by intervals of 250 m/min, between 1,000 m/min and 5500 m/min, an undrawn polyethylene terephthalate multifilament yarn composed of 48 filaments, each having the expected thickness of 2 denier was prepared. Similarly, multifilament yarns in which the filaments had expected thicknesses of 3, 4, 5 or 6 denier were also prepared. Thus, 95 different undrawn polyester multifilament yarns were prepared in total.

Each of the undrawn multifilament yarns, the effects of the combination of the draw ratio and the drawing temperature were examined. That is, the above-mentioned multifilament yarns were drawn at different temperatures with different draw ratios. Each drawn yarn was knitted into a plain knitted fabric of 24 gauge and then subjected to the dying test described in Experiment 1. The test results revealed that when judged from the desired salt and pepper effect, (the draw ratio)/(the natural draw ratio) should preferably be not less than 0.2 and (the drawing temperature — the crystallization initiating temperature)/(the melting point — the crystalization initiating temperature) should preferably be not more than 0.6. The optimum results were obtained when the former ratio was about 0.75 and the latter ratio was about 0.22.

EXPERIMENT 8

Each of the undrawn multifilament yarns prepared as described in Experiment 7 was drawn by deflectively contacting the running yarn with a heated member heated at a temperature as described in Experiment 8, using an angle of contact ($\theta$) of 18° and a time of contact of 0.09 sec. The drawn yarn was knitted into a plain knitted fabric of 24 gauge and then tested in the manner as described in Experiment 1.

The results will be described with reference to FIG. 13. Undrawn yarns falling within the area B in FIG. 13 has a natural draw ratio of 1.2 to 2.5 and from such undrawn yarns desired multifilament yarns in accordance with the invention could be obtained. Undrawn yarns within the area C had a natural draw ratio of less than 1.2 and from such undrawn yarns multifilament yarns in accordance with the present invention could not be prepared under the drawing conditions specified above. Undrawn yarns within the area A has a natural draw ratio of above 2.5. When the drawn yarn prepared from such undrawn yarns within the area A were false twisted, yarn breakage frequently occurred revealing the unsuitable processability of the yarn for mass production. With respect to the undrawn yarns within the area D, the value of the denier of each undrawn filament divided by $\alpha_o^{3/2}$, wherein $\alpha_o$ represents the natural draw ratio of the filament, was above 4. An air jet interlaced yarn prepared from the drawn yarn produced from an undrawn yarn within the area D has a poor fluffy appearence when compared with a 100% polyester spun yarn (3 denier × 89 mm , $60^S$ in meter system). Undrawn yarns falling within the area E in FIG. 13 has such a natural draw ratio ($\alpha_o$) that the value of the denier of each undrawn filament divided by $\alpha_o^{3/2}$ was above 5. An air jet interlaced yarn prepared starting from such an undrawn yarn falling within the area E was much more inferior with respect to yarn appearence.

Figure 13:
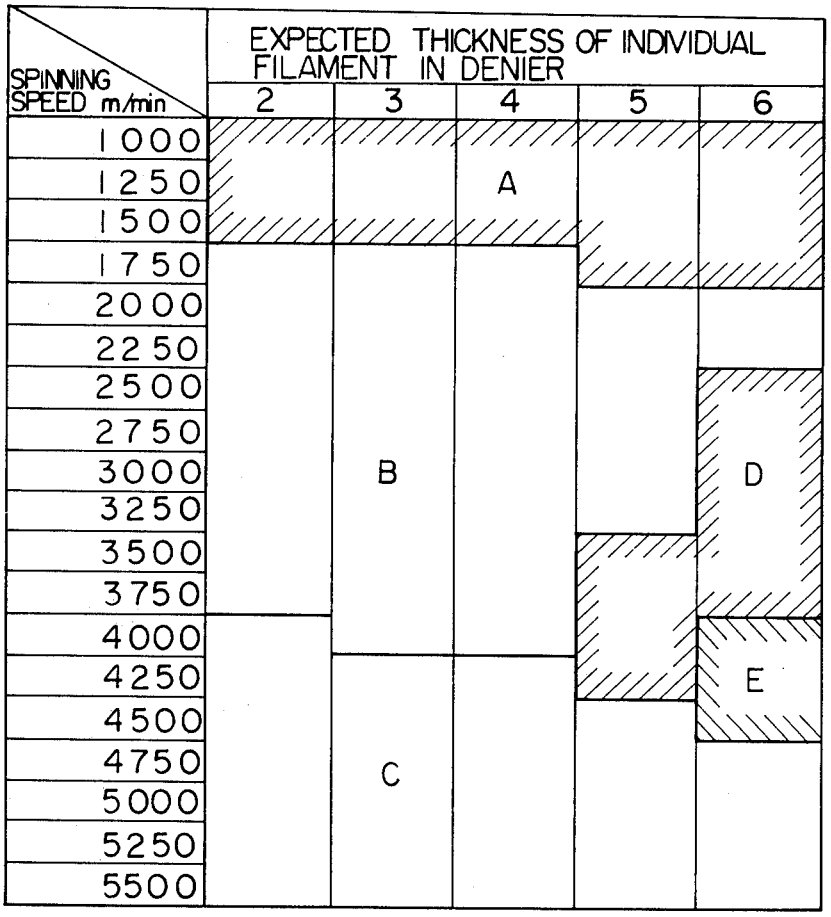
FIG. 13 is a table representation indicating the relation between the spinning speed and (thickness of undrawn filament)/natural draw ratio (%) together with the quality characteristic identification of the multifilament yarns, produced by an experimental test according to the present invention.

Using undrawn yarns falling within the area B in FIG. 13, experiments were carried out in order to examine the effects of the angle of contact. The results of the experiments revealed that as the angle of contact increases, the standard deviation (W) of the average sectional area of individual filaments in a section of the resultant yarn increases, and; that an angle of contact exceeding 30° provides a product in which said standard deviation (W) is not less than one-fourth power of the quotient of the standard deviation (V) of the sectional area of individual filaments divided by the average number of filaments constituting optional sections of the multifilament yarn.

In order to examine the effects of the heating time, drawing experiments were carried out using undrawn yarns falling within the area B in FIG. 13. In these experiments the yarns were drawn while they were passing through a heating zone without being in contact with a heated solid member. As a result of the experiments it was found that the standard deviation (W) of the average sectional area of individual filaments in the optional section of the drawn yarn increase as the heating time is shortened and vice versa, and; further, that a heating time ranging between 0.005 second and 0.3 second is essential for attaining the yarn configuration according to the invention.

EXPERIMENT 9

Sample undrawn multifilament yarns were selected from the yarns produced by experiment 1. The expected thickness of individual undrawn filaments of these selected yarns were 2*d* and 6*d*, respectively. These undrawn multifilament yarns were heat treated under stretched condition so as to improve the so-called heat-stability and improve the mechanical properties thereof by enhancing the crystallization. The above-mentioned heat treatment was carried out at a temperature higher than the drawing temperature and for a time longer than the time of heating in the drawing operation. It was confirmed that, the portions of individual filaments which were not sufficiently drawn were crystalized so that these portions became brittle. Consequently, if such drawn multifilament yarn is utilized as a material for producing the interlaced textured yarn, a yarn having numerous buzzy fibers like the embodiment illustrated in Experiment 2 can be easily produced.

EXPERIMENT 10

The polyester undrawn multifilament yarns belonging to the region B of FIG. 13 were utilized for this experiment. The expected thickness of the undrawn individual filaments of the above-mentioned yarns were 3*d*, 4*d*. Such undrawn multifilament yarns were subjected to a friction type false twisting operation by means of a false twisting apparatus disclosed in the Japanese laid open publication No. 99431/1973 (applicant, Ernest Seragg & Sons Ltd.). Due to the above-mentioned false twisting, parts of individual filaments were cut. In the above-mentioned experiment, the roughness of the surface of the abrasion member was changed to several different conditions and the processing yarn tension was also changed, so as to find the preferable conditions. It was confirmed that the most preferable condition of the above-mentioned roughness was between 0.5 and 3.0 ($\mu$), because preferable fuzzy fibers could then be created. However, it was confirmed that if the processing yarn tension was increased so as to create fuzzy fibers positively, the processability of the yarn was injured.

EXPERIMENT 11

Figure 14:
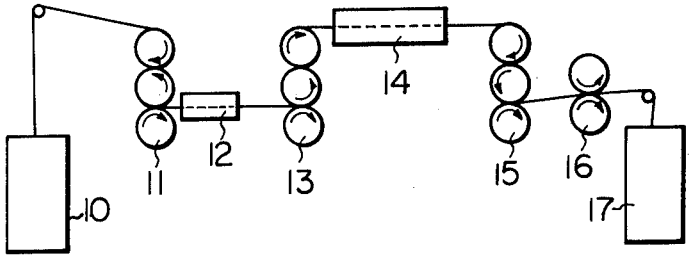
FIG. 14 is a schematic elevational view of an apparatus for draft-cutting of a bundle of the multifilament yarn according to the present invention.

Polyethylene terephthalate was melt-spun and taken up at a take-up speed of 2000 m/min, and an undrawn tow of 60000*d*/10000*f* was produced. This tow was reserved into a can 10 as shown in FIG. 14. The thus produced undrawn tow was drawn under the conditions which satisfy the requirement of the method according to the present invention and, then, the drawn tow was subjected to a draft-cut process so as to produce a sliver. The above-mentioned drawing process and draft cut process were carried out successively as a combined process as shown in FIG. 14. The operational conditions of the elements of the above-mentioned combined process were as follows.

The tow supply device 11: supply speed 20 m/min
The first heater 12 12: temperature 140° C
The first takeup device 13: takeup speed 38 m/min
The second heater 14: heating temperature 180° C
The second takeup device 15: takeup speed 40 m/min
The draft cut device 16: takeup (or draft cut speed) 200 m/min The silver produced by the above-mentioned process was reserved in a can 17, as shown in FIG. 14, and utilized as a material for producing a spun yarn. The sliver was drafted under a draft ratio of 40 and, then, a spun yarn S, 600 t/m was produced. It was observed that the configuration of the above-mentioned spun yarn satisfied the condition of the multifilament yarn according to the present invention and that the uniformity of this spun yarn was 13% (*u*%). In other words, the thickness variation of this spun yarn was excellent in comparison with the conventional spun yarn.

EXPERIMENT 12

The multifilament yarn produced by the experiment 9, composed of 2*d* individual filaments, was doubled with the conventional polyestel multifilament yarn 100*d*/48*f*. The thus produced doubled yarn was subjected to the identical interlacing treatment as that used in experiment 2. It was observed that the individual filaments were interlaced each other, while parts of individual filaments were broken at their brittle portions and, consequently, a spun like yarn appearance was created. Since the above-mentioned conventional polyester multifilament yarn was maintained in continuous endless condition, in the interlaced yarn, the tensile strength of the above-mentioned yarn was very high and a very uniform yarn like the yarn produced by the experiment 12 was obtained.

What is claimed is:

1. A polyester yarn composed of a plurality of individual fibrous materials, each of said fibrous materials provided with thicker cross-sectional portions, thinner cross-sectional portions and intermediate thickness-size portions randomly distributed along the axial direction thereof, said distribution of cross-sections of fibrous material characterized by the following four conditions, a. a distribution curve of the cross-sectional area of said individual fibrous materials is deviated to the thinner side, b. the degree of variability, V/S, of said cross-sectional area of said individual fibrous materials, where V is the standard deviation and S is the mean value, is in a range between 7% and 30%, c. in the distribution of the cross-sectional areas of said fibrous materials, if the range of distribution is divided in such a way that the distribution range in the thicker side from the average value is divided by a width corresponding to ½ of the standard deviation thereof, the distribution frequency in any class defined by the above-mentioned method of division is less than three times the distribution frequency in a class adjacent to said specific class in the thinner side of the distribution.

d. the standard deviation of the average cross-sectional area of individual fibrous materials in optional cross sections of said multifilament yarn is smaller than the quotient of the standard deviation of said fibrous materials divided by the one-fourth power of the average number of said fibrous materials constituting said optional cross sections of said multifilament yarn.

2. Polyester yarn according to claim 1, wherein all of said fibrous materials are individual filaments.

3. Polyester multifilament yarn according to claim 2, wherein said individual filaments are interlaced with each other.

4. Polyester multifilament yarn according to claim 2, wherein adhered portions of said yarn are randomly distributed along the yarn axis thereof, each of said adhered portions is provided with such a configuration that thicker portions of some individual filaments are partly melted and these thicker portions adhere to a plurality of thinner portions of individual filaments surrounding them.

5. Polyester multifilament yarn according to claim 2, wherein said yarn is a false twisted yarn.

6. Polyester multifilament yarn accordng to claim 2, wherein each individual filament is provided with crimps created by a texturing treatment.

7. Polyester yarn according to claim 1, wherein some of said fibrous materials are a plurality of fibers.

8. Polyester yarn according to claim 1, wherein all of said fibrous materials are fibers.

9. Polyester yarn according to claim 8, wherein said fibers are provided with variable length, and are distributed randomly along the yarn axis thereof and interlaced with each other, an average value of the cross-sectional area at an end portion of said fibers is larger than an average value of optional cross sectional areas of said fibers, and the variation of thickness of said yarn is below $80/\sqrt{n}$ in *u*%, wherein *n* represents an average number of fibers in an optional cross section of said yarn.

* * * * *